US008695552B2

(12) United States Patent
Onozawa et al.

(10) Patent No.: US 8,695,552 B2
(45) Date of Patent: Apr. 15, 2014

(54) TEMPERATURE CONTROL SYSTEM FOR INTERNAL COMBUSTION ENGINE

(75) Inventors: Satoru Onozawa, Anjo (JP); Takashi Suzuki, Gotenba (JP)

(73) Assignees: Aisin Seiki Kabushiki Kaisha, Kariya-Shi, Aichi-Ken (JP); Toyota Jidosha Kabushiki Kaisha, Toyota-Shi, Aichi-Ken (JP)

( * ) Notice: Subject to any disclaimer, the term of this patent is extended or adjusted under 35 U.S.C. 154(b) by 196 days.

(21) Appl. No.: 13/169,484

(22) Filed: Jun. 27, 2011

(65) Prior Publication Data

US 2012/0055663 A1 Mar. 8, 2012

(30) Foreign Application Priority Data

Sep. 7, 2010 (JP) ..... 2010-200111

(51) Int. Cl.
*B60H 1/03* (2006.01)

(52) U.S. Cl.
USPC ..... 123/142.5 E; 123/142.5 R; 123/41.01; 123/41.15

(58) Field of Classification Search
USPC ..... 123/142.5 E, 142.5 R, 41.01, 41.15
See application file for complete search history.

(56) References Cited

U.S. PATENT DOCUMENTS 5,781,877 A * 7/1998 Rachel et al. ..... 701/104
5,884,243 A 3/1999 Tanigushi et al.
7,757,649 B2 * 7/2010 Wakahara ..... 123/142.5 E
7,975,536 B2 * 7/2011 Bommer et al. ..... 73/114.68
8,140,246 B1 * 3/2012 Manchanda ..... 701/107
2004/0035194 A1 * 2/2004 Wakahara ..... 73/118.1

FOREIGN PATENT DOCUMENTS

JP 10-73047 A 3/1998
JP 2000-282862 A 10/2000
JP 2007-192045 A 8/2007
JP 2008-298058 A 12/2008
JP 2010-101190 A 5/2010

OTHER PUBLICATIONS

Office Action (Reason) dated Aug. 30, 2012, issued by the Japanese Patent Office in corresponding Japanese Patent Application No. 2010-200111, and an English translation of the Office Action (4 pages).

* cited by examiner

*Primary Examiner* — Marguerite McMahon
*Assistant Examiner* — James Kim
(74) *Attorney, Agent, or Firm* — Buchanan Ingersoll Rooney PC

(57) ABSTRACT

A temperature control system for an internal combustion engine, to which a block heater for warming a coolant and keeping the coolant warm is attachable, the temperature control system includes a coolant circulating apparatus circulating the coolant, a fluid temperature detecting device detecting a fluid temperature of the coolant, a block heater disuse estimating portion estimating a possibility of disuse of the block heater under a condition that a circulation of the coolant is stopped, and a block heater usage determining portion determining whether or not the block heater is used on the basis of changes in the fluid temperature under a condition that the coolant is circulated in a case where the block heater disuse estimating portion does not estimate the disuse of the block heater.

17 Claims, 4 Drawing Sheets

TEMPERATURE CONTROL SYSTEM FOR INTERNAL COMBUSTION ENGINE

CROSS REFERENCE TO RELATED APPLICATIONS

This application is based on and claims priority under 35 U.S.C. §119 to Japanese Patent Application 2010-200111, filed on Sep. 7, 2010, the entire content of which is incorporated herein by reference.

TECHNICAL FIELD

This disclosure generally relates to a temperature control system for an internal combustion engine, to which a block heater for keeping a coolant warm is attachable. More specifically, this disclosure pertains to the temperature control system having a function of determining a usage of the block heater.

BACKGROUND DISCUSSION

Generally, an engine temperature is used as an important parameter used for a known temperature control system for an internal combustion engine. However, in practice, a cooling water temperature (i.e. a coolant temperature) is used as a value representing the engine temperature. In the known temperature control system for the internal combustion engine, various controls of the internal combustion engine are executed on the basis of the cooling water temperature, which is detected by a water temperature sensor. Therefore, detecting a malfunction of the water temperature sensor (i.e. a fluid temperature detecting means) is crucial. Accordingly, various methods and devices for detecting the malfunction of the water temperature sensor have been suggested.

For example, a fault diagnostic device for a water temperature sensor disclosed in JPH10-073047A is configured to determine that a malfunction such as a characteristic displacement and the like occurs at the water temperature sensor in a case where a cooling water temperature, which is detected by the water temperature sensor when a predetermined time has been elapsed since an internal combustion engine is started, is lower than a reference value.

According to an abnormality detection device of a temperature sensor disclosed in JP2007-192045A, a soaking time of an internal combustion engine necessary for a difference between a temperature detected by a water temperature sensor and a temperature detected by an intake air temperature sensor to fall within a range of a predetermined temperature difference after the internal combustion engine is stopped is set to a predetermined time. The abnormality detection device determines that the water temperature sensor and the intake air temperature sensor are both in a normal state in a case where the temperature difference between the temperature detected by the temperature sensor, which detects a cooling water temperature of the internal combustion engine, and the temperature detected by the intake air temperature sensor, which detects an intake air temperature of the internal combustion engine, falls within the predetermined range in a case where a down time of the internal combustion engine reaches a predetermined time. On the other hand, in a case where the temperature difference falls outside the range of the predetermined temperature difference, the abnormality detection device determines that a malfunction occurs at either one of the water temperature sensor and the intake air temperature sensor. Furthermore, even in a case where a block heater is attached at an engine block in order to partially heat a cooling water in the vicinity of a combustion chamber while the internal combustion engine is stopped, the temperature sensor detects a temporal decrease of the temperature, which is detected by the water temperature sensor, during a predetermined temperature fluctuation period immediately after the internal combustion engine is started in order to avoid a mis-determination of a state of the water temperature sensor and the intake air temperature sensor.

Disclosed in JP2008-298058A is a control device of an internal combustion engine having a block heater determining means, which is configured so as to determine whether or not a block heater is electrified (used) while the internal combustion engine is being stopped on the basis of changes in a cooling water temperature immediately after the internal combustion engine is started or on the basis of changes in a rotational speed of the internal combustion engine.

According to the above-described known temperature control systems, the malfunction of the fluid temperature detecting sensor, which detects the fluid temperature of the coolant, is detected on the basis of the changes in the temperature, which is detected by the fluid temperature sensor and which may occur due to a circulation of the coolant that is heated within the internal combustion engine and whose post-heating is extracted. Therefore, a process for determining the malfunction of the fluid temperature detecting sensor and the process for determining a usage of the block heater are executed under the assumption that the coolant is circulated.

There exists a technology to effectively perform a warm-up drive in a manner where the warm-up drive is performed while a circulation of a cooling water is stopped. For example, the warm-up drive may be achieved in a manner where an electric pump is adapted as a pump for circulating the cooling water and the electric pump stops the circulation of the cooling water independently of a drive of an internal combustion engine. Furthermore, a thermostat (or a combination of an fluid temperature sensor and a control valve, which are configured independently of and separately from each other) may be provided on a coolant circulating passage, which is used for circulating the cooling water between the internal combustion engine and a radiator. For example, the thermostat is closed to stop the circulation of the cooling water between the internal combustion engine and the radiator while a coolant temperature is lower than a predetermined temperature in order to achieve the warm-up drive for promptly increasing the coolant temperature at the internal combustion engine. Accordingly, in the case where the circulation of the cooling water is stopped when the internal combustion engine is started, the above-described process for detecting the malfunction of the fluid temperature sensor and the process for determining the usage of the block heater may not be executable.

A need thus exists for a temperature control system for an internal combustion engine which is not susceptible to the drawback mentioned above.

SUMMARY

According to an aspect of this disclosure, a temperature control system for an internal combustion engine, to which a block heater for warming a coolant and keeping the coolant warm is attachable, the temperature control system includes a coolant circulating apparatus configured so as to circulate the coolant, a fluid temperature detecting device configured so as to detect a fluid temperature of the coolant, a block heater disuse estimating portion configured so as to estimate a possibility of disuse of the block heater under a condition that a circulation of the coolant is stopped, and a block heater usage determining portion configured so as to determine whether or not the block heater is used on the basis of changes in the fluid temperature under a condition that the coolant is circulated in a case where the block heater disuse estimating portion does not estimate the disuse of the block heater.

According to another aspect of this disclosure, a temperature control system for an internal combustion engine, to which a block heater for warming a coolant and keeping the coolant warm is attachable, the temperature control system includes a coolant circulating apparatus configured so as to circulate the coolant, a fluid temperature detecting device configured so as to detect a fluid temperature of the coolant, a block heater disuse estimating portion configured so as to estimate whether or not the block heater is used under a condition that a circulation of the coolant is stopped, and a block heater usage determining portion configured so as to determine whether or not the block heater is used under a condition that the coolant is circulated.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
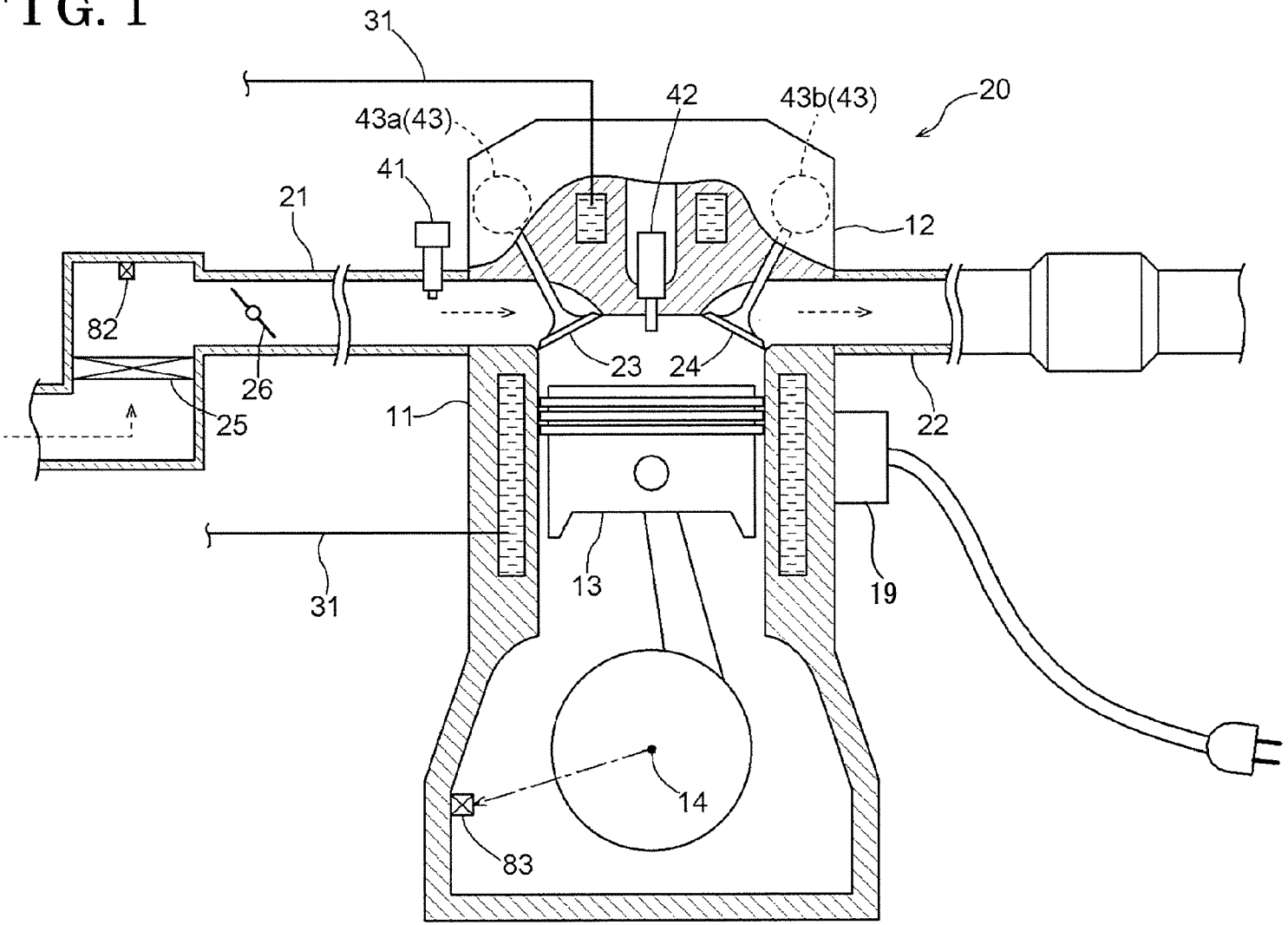
FIG. 1 is a diagram schematically illustrating a cylinder configuring a temperature control system for an internal combustion engine according to an embodiment.
Figure 2:
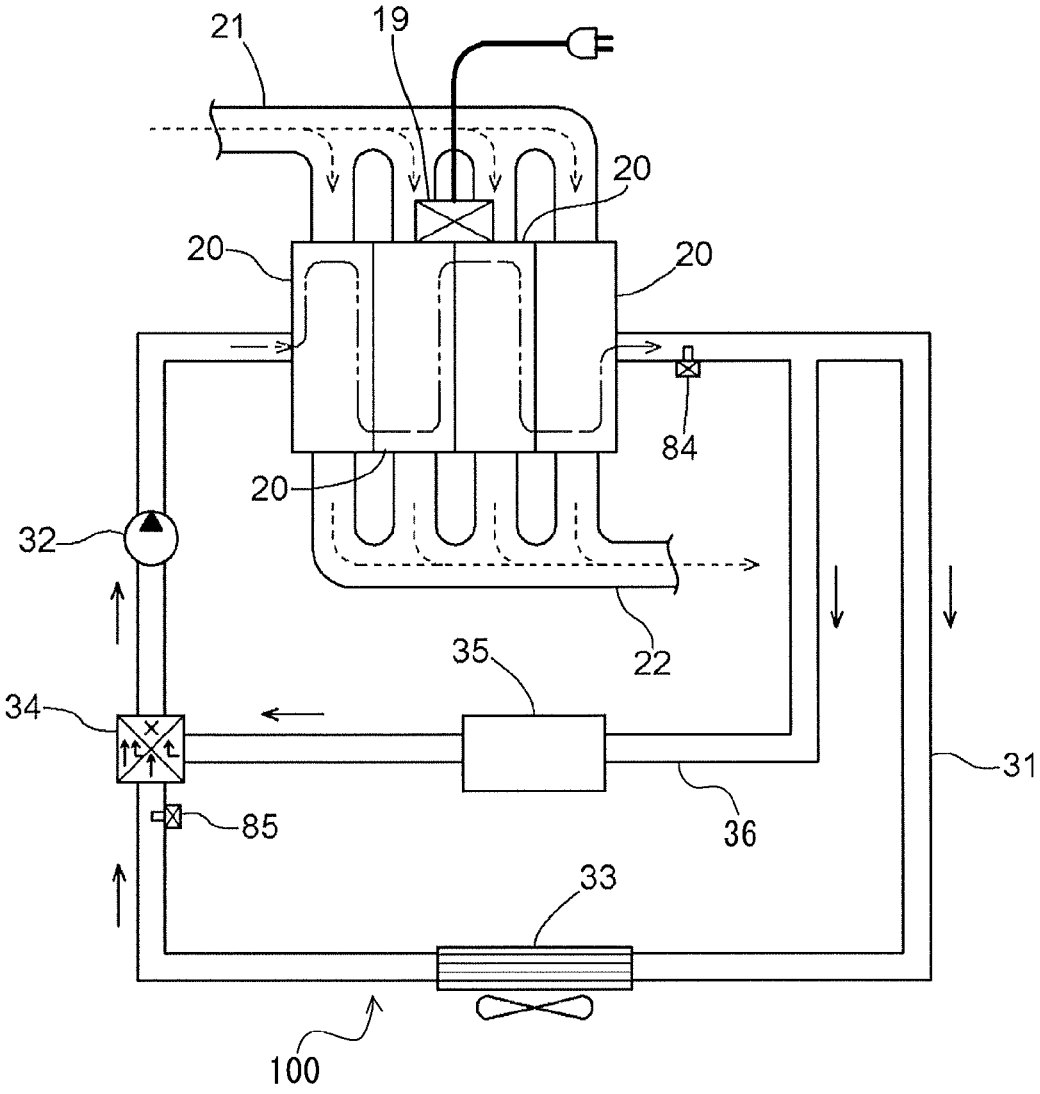
FIG. 2 is a diagram schematically illustrating a relationship between the internal combustion engine including plural cylinders and a coolant passage.

An embodiment of a temperature control system for an internal combustion engine will be described below with reference to the attached drawings. Illustrated in FIG. 1 is a schematic diagram of an example of the temperature control system for the internal combustion engine by using one of plural cylinders 20, which configure the internal combustion engine. Illustrated in FIG. 2 is a schematic diagram of a configuration of the entire internal combustion engine. The internal combustion engine having plural cylinders 20 is mounted on a vehicle. The internal combustion engine includes an internal combustion engine housing, which is configured by a cylinder block 11, a cylinder head 12 and the like. In this embodiment, the internal combustion engine housing will be referred to as a wall member. Specifically, a portion of the wall member located in the vicinity of each cylinder 20 will be referred to as a cylinder wall member. An ignition device 42, whose end portion protrudes into a combustion chamber defined by the corresponding cylinder 20, is provided at the wall member of the cylinder head 12. Furthermore, a piston 13 is provided at each cylinder 20. The pistons 13 are interlinked with a crankshaft 14. A portion of an intake passage 21, through which air flows into each combustion chamber via a corresponding intake valve 23, and a portion of an exhaust passage 22, through which an exhaust gas is discharged from each combustion chamber via a corresponding exhaust valve 24, are formed within the wall members of the cylinder block 11 and the cylinder head 12. A fuel injection valve 41, which injects a predetermined amount of fuel into the intake passage 21, is provided at each intake passage 21. Furthermore, an air cleaner 25 for cleaning the air taken into each combustion chamber and a throttle valve 26 for adjusting an amount of the air flowing within the intake passage 21 are provided at each intake passage 21. An intake air temperature sensor 82 for detecting an intake air temperature (i.e. an ambient air temperature) is provided so as to correspond to an area of the air cleaner 25. The intake air temperature detected by the intake air temperature sensor 82 is also referred to as an environmental temperature. A variable valve timing mechanism 43 (i.e. a variable intake valve timing mechanism 43*a*) for adjusting an opening/closing timing of the intake valve 23 is provided at each intake valve 23. Similarly, the variable valve timing mechanism 43 (i.e. a variable exhaust valve timing mechanism 43*b*) for adjusting an opening/closing timing of the exhaust valve 24 is provided at each exhaust valve 24.

A combustible mixture of the fuel and the air is explosively combusted (exploded) within each combustion chamber in response to an actuation of the corresponding ignition device 42. Accordingly, each piston 13 is actuated while receiving a combustion pressure generated when the combustible mixture is explosively combusted, thereby rotating the crankshaft 14. A vehicle driving system and an auxiliary system (e.g. a compressor of an air conditioner, an alternator, a torque converter, a hydraulic pump of a power steering and the like) are actuated in response to a rotational torque generated by the crankshaft 14. A crankshaft angle sensor 83 for detecting a rotational angle (i.e. a crank angle) of the crankshaft 14 is provided in the vicinity of the crankshaft 14. The exhaust gas generated after the fuel is combusted at each combustion chamber is discharged to an outside of the internal combustion engine through the corresponding exhaust passage 22. An energy resulting from the combustion and generated within the internal combustion engine remains at the wall member as a heat.

A coolant circulating apparatus 100 is provided at the internal combustion engine in order to avoid a temperature of the wall member from becoming too high because of the heat remaining at the wall member (i.e. a residual heat). The coolant circulating apparatus 100 includes a coolant passage 31 (a circulation passage) through which a cooling water serving as a coolant is circulated, an electric pump 32 serving as a cooling water pump, a radiator 33 and a flow controlling valve 34. In this embodiment, a portion of the coolant passage 31 formed at the wall member is also referred to as a water jacket. The electric pump 32 (i.e. the cooling water pump) is provided in the vicinity of an inlet of the water jacket. The electric pump 32 is configured so as to be driven by an electric motor, so that the electric pump 32 is actuated independently of a rotation of the crankshaft 14. Furthermore, the electric pump 32 is configured so as to suck the cooling water flowing through the coolant passage 31, which is connected to the radiator 33, and then supplies the cooling water to the inlet of the water jacket. The cooling water absorbs the heat from the wall member when passing through the water jacket, so that a temperature of the cooling water (which will be hereinafter referred to as a cooling water temperature) increases. The cooling water, whose water temperature is increased, releases the heat when passing through the radiator 33, so that the cooling water temperature decreases. A bypass passage 36 is provided at the cooling circulating apparatus 100 in order to connect an outlet of the water jacket and a suction port of the electric pump 32 while avoiding the radiator 33 (i.e. so as not to pass through the radiator 33). A heater core 35 is provided at the bypass passage 36. The flow controlling valve 34 is provided at a connecting area between the coolant passage 31 extending from the radiator 33 and the bypass passage 36. The flow controlling valve 34 is configured so as to control the temperature of the cooling water for cooling the wall member. For example, in a case where a valve opening degree of the flow controlling valve 34 is adjusted so as to increase the flow of the cooling water passing through the radiator 33, the temperature of the cooling water for cooling the wall member decreases. On the other hand, in a case where the valve opening degree of the flow controlling valve 34 is adjusted to as to reduce the flow of the cooling water passing through the radiator 33, the temperature of the cooling water for cooling the wall member increases because an amount of the cooling water cooled down by the radiator 33 decreases. A first fluid temperature detecting sensor 84 for detecting the temperature of the cooling water after passing through the outlet of the water jacket is provided at a portion of the coolant passage 31 so as to be positioned in the vicinity of the outlet of the water jacket. Furthermore, a second fluid temperature detecting sensor 85 for detecting the temperature of the cooling water after passing through the radiator 33 is provided at the coolant passage 31 so as to be positioned in the vicinity of the flow controlling valve 34. In this embodiment, the coolant circulating apparatus 100 includes both of the first fluid temperature detecting sensor 84 and the second fluid temperature detecting sensor 85. Alternatively, the coolant circulating apparatus 100 may be modified so as to include any one of the first fluid temperature detecting sensor 84 and the second fluid temperature detecting sensor 85. However, in this case, the first fluid temperature detecting sensor 84 is suitable for detecting (monitoring) a state of the residual heat of the wall member. Furthermore, the flow controlling valve 34 and the second fluid temperature detecting sensor 85 may be integrated to configure a thermostat.

A block heater 19 is configured so as to be attached at an outer wall of the internal combustion engine in order to keep the cooling water, which remains at the water jacket, warm. Furthermore, the block heater 19 is configured so as to be attached at the outer wall of the internal combustion engine by a user and so as to be connected to an electric lamp line in order to electrify the block heater 19 through the electric lamp line.

In a case where the electric pump 32 is adapted as the cooling water pump for circulating the cooling water, the circulation of the cooling water may be stopped independently of the drive of the internal combustion engine. Therefore, the internal combustion engine may be started while the circulation of the cooling water within the coolant circulating apparatus 100 is stopped in order to effectively execute a warm-up drive. Furthermore, the circulation of the cooling water flowing through the radiator 33 may be stopped in a case where the cooling water temperature is detected to be lower than a predetermined temperature by means of the flow controlling valve 34, which is provided at the coolant passage 31 through which the cooling water is circulated between the internal combustion engine and the radiator, and the second fluid temperature detecting sensor 85, in order to achieve the warm-up drive for promptly increasing the cooling water temperature at the internal combustion engine. Additionally, the flow controlling valve 43 and the second fluid temperature detecting sensor 85 may be integrated so as to form the thermostat.

Figure 3:
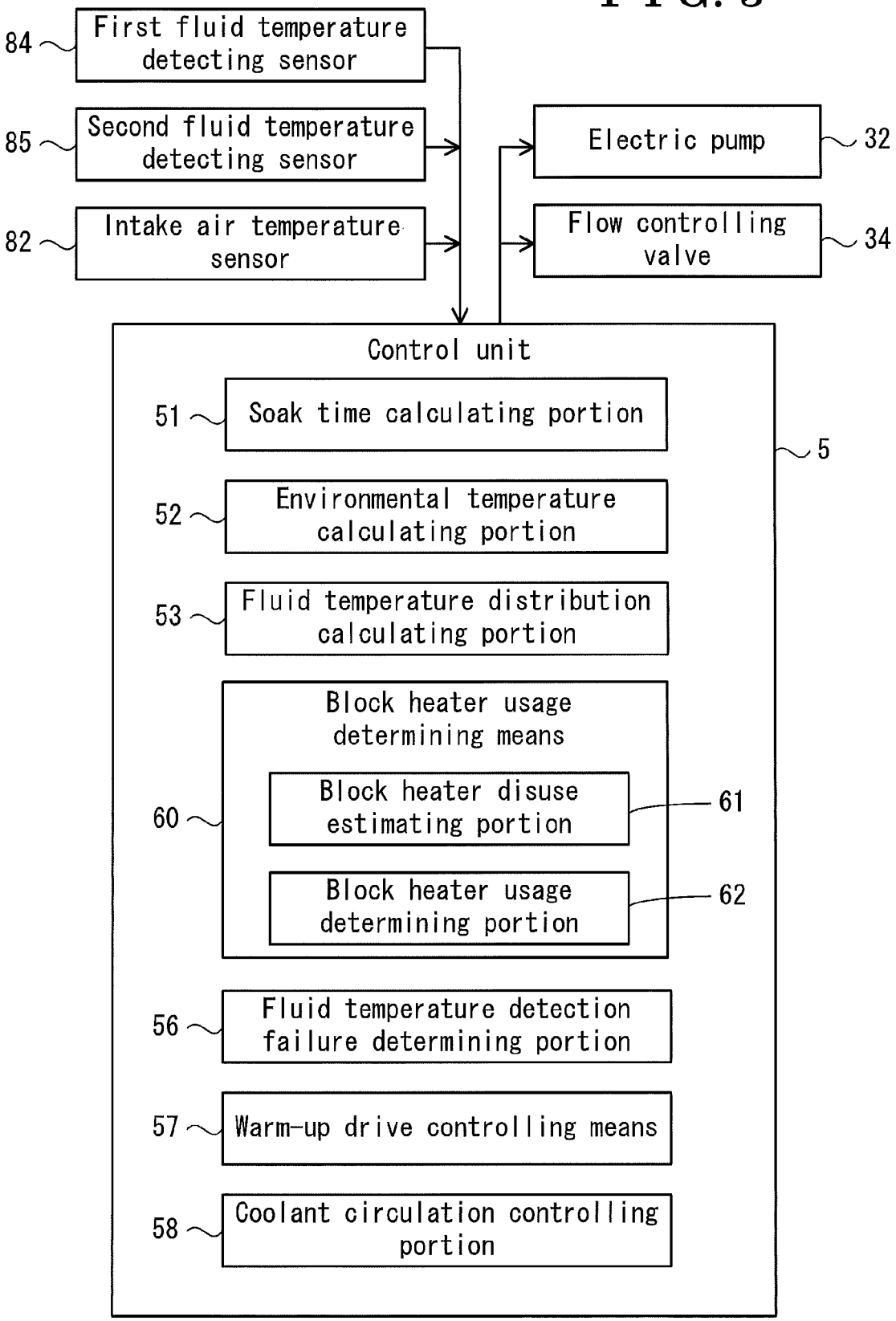
FIG. 3 is a functional block diagram for explaining a control system of the temperature control system for the internal combustion engine.

Illustrated in FIG. 3 is a functional block diagram of a control unit 5, which serves as a core component of the temperature control system, which is adapted for the temperature control system for the internal combustion engine according to this embodiment. The control unit 5 is also referred to as an electronic control unit (ECU). The control unit 5 is configured with a microcomputer as a core component. Furthermore, the control unit 5 is configured so as to execute various functions relating to a temperature control of the internal combustion engine in a manner where the control unit 5 executes various programs stored within a read-only memory (ROM) included in the control unit 5. Therefore, detection signals from various sensors such as the intake air temperature sensor 82 for detecting the ambient temperature serving as the environmental temperature, the first fluid temperature detecting sensor 84, the second fluid temperature detecting sensor 85 and the like are inputted into the control unit 5. Furthermore, the control unit 5 is directly or indirectly connected to control targets such as the electric pump 32, the flow controlling valve 34 and the like, so that the control unit 5 is configured so as to transmit a control signal to each control target.

The control unit 5 includes functional portions such as a soak time calculating portion 51, an environmental temperature calculating portion 52, a fluid temperature distribution calculating portion 53, a block heater usage determining means 60, a fluid temperature detection failure determining portion 56 (i.e. a failure determining portion), a warm-up drive controlling portion 57 and a coolant circulation controlling portion 58, which relate to the temperature control system according to this embodiment. The soak time calculating portion 51 calculates (times) a soak time (i.e. a down time) corresponding to a duration of time from when the internal combustion engine is stopped to when the internal combustion engine is started by using an internal clock. The environmental temperature calculating portion 52 calculates the environmental temperature, which corresponds to the ambient temperature, on the basis of the detection signal outputted from the intake air temperature sensor 82. The fluid temperature distribution calculating portion 53 is configured so as to detect the temperature of the cooling water flowing in the vicinity of an outlet of the internal combustion engine at a point of time when the detection signal is outputted from the first fluid temperature detecting sensor 84 or temporal changes in the temperature of the cooling water flowing in the vicinity of the outlet of the internal combustion engine on the basis of the detection signal outputted from the first fluid temperature detecting sensor 84. Furthermore, the fluid temperature distribution calculating portion 53 is configured so as to calculate a further accurate temperature distribution of the temperature of the cooling water flowing through the coolant passage 31 by using the detection signals from the first and second fluid temperature detecting sensors 84 and 85 depending on circumstances. In this embodiment, the first fluid temperature detecting sensor 84 and the fluid temperature distribution calculating portion 53, and the second fluid temperature detecting sensor 85 depending on the circumstances, configure a fluid temperature detecting device. The fluid temperature detection failure determining portion 56 is configured so as to execute a failure determination of the component of the fluid temperature detecting device such as the first fluid temperature detecting sensor 84, the second fluid temperature detecting sensor 85, the fluid temperature distribution calculating portion 53 and the like on the basis of changing patterns of the detected water temperature of the circulating cooling water, as is disclosed as a failure determination algorithm used in the fault diagnostic device for the water temperature sensor disclosed in JPH10-073047A, the abnormality detection device of the temperature sensor disclosed in JP2007-192045A and the like.

The warm-up drive controlling portion 57 is configured so as to determine whether or not a warm-up drive without the circulation of the cooling water is executed and so as to control the warm-up drive on the basis of an engine state information. The engine state information relates to an engine state generated on the basis of a detection data, such as the temperature of the wall member, the cooling water temperature, the intake air temperature, a pressure within each cylinder 20, a fuel injection amount, a crank angle and the like, and a calculation data. The coolant circulation controlling portion 58 is configured so as to control the electric pump 32, the flow controlling valve 34 and the like in order to allow or stop the circulation of the cooling water. More specifically, in a case where the coolant circulation controlling portion 58 receives an order of executing the warm-up drive without the circulation of the cooling water from the warm-up drive controlling portion 57, the coolant circulation controlling portion 58 controls the electric pump 32, the flow controlling portion 34 and the like in order to stop the circulation of the cooling water. Furthermore, the coolant circulation controlling portion 58 controls the electric pump 32, the flow controlling valve 34 and the like in order to circulate the cooling water, which is necessary for the determination executed by the fluid temperature detection failure determining portion 56.

The block heater usage determining means 60 is configured so as to determine whether or not the user attaches the block heater 19 at the internal combustion engine and whether or not the temperature of the cooling water is kept to be warm or whether or not the cooling water is heated up while the internal combustion ending is stopped. The block heater usage determining means 60 includes a block heater disuse estimating portion 61 and a block heater usage determining portion 62. The block heater disuse estimating portion 61 is configured so as to estimate a possibility of disuse of the block heater 19 while the circulation of the cooling water is stopped. On the other hand, the block heater usage determining portion 62 is configured so as to determine whether or not the block heater 19 is in use on the basis of changes in the water temperature while the cooling water is circulated, in a case where the block heater disuse estimating portion 61 does not estimate the possibility of the disuse of the block heater 19.

According to an estimation algorithm set at the block heater disuse estimating portion 61, as a first step, the block heater disuse estimating portion 61 estimates that the block heater 19 is not in use in a case where the soak time is not long enough to attach the block heater 19 to the internal combustion engine and to heat the cooling water. Then, as a second step, the block heater disuse estimating portion 61 estimates that the block heater 19 is not used in a case where the intake air temperature, which corresponds to the environmental temperature, reaches a temperature that indicates a non-necessity of heating the internal combustion engine by using the block heater 19. Furthermore, the block heater disuse estimating portion 61 estimates that the block heater 19 is not in use in a case where the soak time is long and where a difference between the cooling water temperature and the intake air temperature is small. On the other hand, a determination algorithm is set at the block heater usage determining portion 62. According to the determination algorithm, the block heater usage determining portion 62 checks whether or not a temperature difference between a current cooling water temperature and a maximum cooling water temperature, in other words, a decrease of the cooling water temperature from when the engine is started and to a present time, is greater than a threshold value. In a case where the decrease of the cooling water temperature is greater than the threshold value, the block heater usage determining portion 62 determines that the block heater 19 is used. On the other hand, in a case where the decrease of the cooling water temperature is equal to or smaller than the threshold value, the block heater usage determining portion 62 determines that the block heater 19 is not used.

Figure 4:
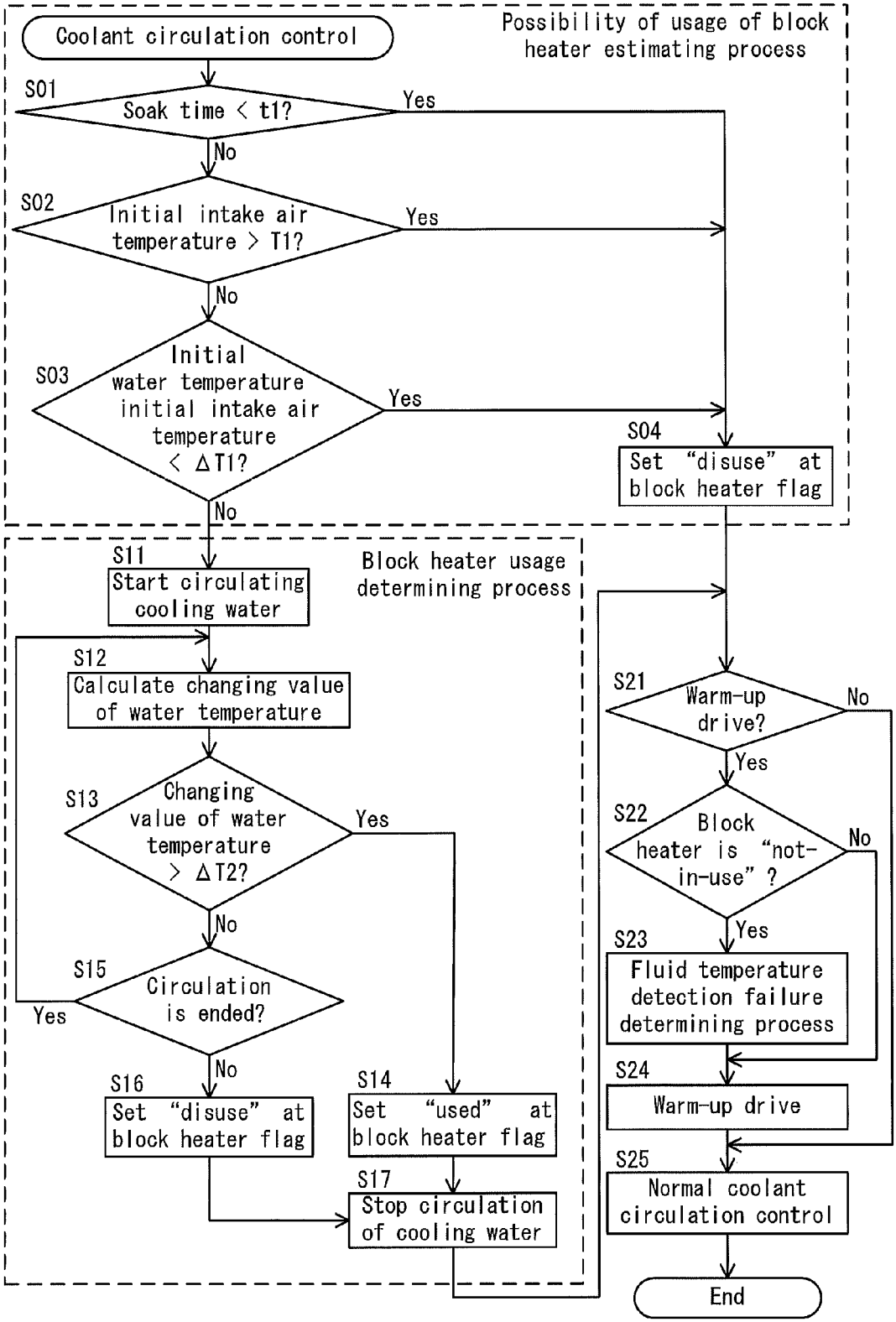
FIG. 4 is a flowchart illustrating an example of an internal combustion engine temperature control executed by the temperature control system for the internal combustion engine.

An example of a coolant circulation controlling process executed by the temperature control system for the internal combustion engine having the control unit 5, which is configured as mentioned above, will be explained below with reference to a flowchart of FIG. 4. Firstly, when the control process is started in response to a turning on of an ignition switch and the like, the soak time is calculated, and then, the control unit 5 compares the calculated soak time with a preliminarily set soak time threshold value t1 (step S1). The threshold value t1 is set so as to correspond to the time necessary for attaching the block heater 19 to the internal combustion engine and heating the cooling water. Therefore, in a case where the soak time is lower than the threshold value t1 (Yes in step S1), the control unit 5 determines that the block heater 19 is not used and sets "disuse" at a block heater flag (step S4). On the other hand, in a case where the soak time is equal to or greater than the threshold value t1 (No in step S1), the control unit 5 compares an initial intake air temperature, which corresponds to the current intake air temperature, with an environmental temperature threshold value T1 (step S2). The threshold value T1 is set to correspond to the environmental temperature that indicates the non-necessity of heating of the internal combustion engine by using the block heater 19. Therefore, in a case where the initial intake air temperature is greater than the threshold value T1 (Yes in step S2), the control unit 5 estimates that the block heater 19 is not in use and sets "disuse" at the block heater flag (step S4). On the other hand, in a case where the initial intake air temperature is equal to or lower than the threshold value T1 (No in step S2), the control unit 5 compares a temperature difference between an initial water temperature, which corresponds to the current cooling water temperature, and the initial intake air temperature with a temperature difference threshold value ΔT1 (step S3). The temperature difference threshold value ΔT1 is set to correspond to the different between the cooling water temperature and the intake air temperature to be generated over a sufficient time. Therefore, in a case where the temperature difference between the initial water temperature and the initial intake air temperature is lower than the temperature difference threshold value ΔT1 (Yes in step S3), the control unit 5 estimates that the block heater 19 is not in use and sets "disuse" at the block heater flag (step S4).

In a case where negative conclusions are determined at all of step S1, step S2 and step S3, which correspond to a possibility of the usage of the block heater estimating process, a block heater usage determining process, which will be described below, is executed.

The block heater usage determination process is executed under a condition where the cooling water is circulated. Therefore, in this process, the cooling water is firstly started being circulated (step S11). When the circulation of the cooling water is started, the control unit 5 calculates (obtains) the cooling water temperature, and calculates the changing value of the water temperature, which corresponds the temporal changes in the temperature of the cooling water, in other words the temperature distribution of the cooling water within the coolant passage 31 while the internal combustion engine is stopped (step S12). Then, the control unit 5 compares the calculated changing value of the water temperature with a preliminarily set threshold value ΔT2 (step S13). In a case where the changing value of the water temperature is greater than the threshold value ΔT2 (Yes in step S13), the control unit 5 determines that the block heater 19 is used on the basis of the above-described algorithm and sets "used" at the block heater flag (step S14). On the other hand, in a case where the changing value of the water temperature is equal to or lower than the threshold value ΔT2 (No in step S13), the control unit 5 determines whether or not the circulation of the cooling water sufficient for the determination is executed (step S15). In a case where the circulation of the cooling water sufficient for the determination is executed (No in step S15) without concluding a positive determination in step S13, the control unit 5 determines that the block heater 19 is not used and sets "disuse" at the block heater flag (step S16). After the process in step S14 or the process in step S16 is completed, the control unit 5 stops the circulation of the cooling water (step S17) and terminates the block heater usage determining process.

Following step S4 or step S17, the control unit 5 determines whether or not the warm-up drive needs to be executed as a process relating to the coolant circulation control (step S21). In a case where the control unit 5 determines that the warm-up drive needs to be executed (Yes in step S21), the control unit 5 checks a state of the block heater flag in order to determine whether or not the block heater 19 is in use (step S22). In the case where the block heater 19 is not in use (Yes in step S22), the control unit 5 executes a fluid temperature detection failure process (step S23) and then executes the warm-up drive (step S24). On the other hand, in the case where the block heater 19 is in use (No in step S22), the control unit 5 executes the warm-up drive (step S24) without executing the fluid temperature detection failure determining process. When the warm-up drive is completed, the control unit 5 executes a normal coolant circulation control (step S25). In a case where the warm-up drive is not executed after the determination in step S21 (No in step S21), the control unit 5 directly shifts to the normal coolant circulation control (step S25).

Accordingly, the temperature control system for the internal combustion engine according to the embodiment may be adaptable to any type of a temperature control system for an internal combustion engine executing a block heater usage determination.

According to the embodiment, the temperature control system for the internal combustion engine, to which the block heater 19 for warming the coolant and keeping the coolant warm is attachable, the temperature control system includes the coolant circulating apparatus 100 configured so as to circulate the coolant, the fluid temperature detecting device (53, 84, 85) configured so as to detect the fluid temperature of the coolant, the block heater disuse estimating portion 61 configured so as to estimate the possibility of the disuse of the block heater 19 under the condition that a circulation of the coolant is stopped, and the block heater usage determining portion 62 configured so as to determine whether or not the block heater 19 is used on the basis of changes in the fluid temperature under the condition that the coolant is circulated in the case where the block heater disuse estimating portion 61 does not estimate the disuse of the block heater 19.

According to the embodiment, the temperature control system for the internal combustion engine, to which the block heater 19 for warming the coolant and keeping the coolant warm is attachable, the temperature control system includes the coolant circulating apparatus 100 configured so as to circulate the coolant, the fluid temperature detecting device (53, 84, 85) configured so as to detect the fluid temperature of the coolant, the block heater disuse estimating portion 61 configured so as to estimate whether or not the block heater 19 is used under the condition that the circulation of the coolant is stopped, and the block heater usage determining portion 62 configured so as to determine whether or not the block heater 19 is used under the condition that the coolant is circulated.

Accordingly, in the case where the control unit 5 determines whether or not the block heater 19 is used while the internal combustion engine is stopped, the block heater disuse estimating portion 61 firstly estimates the possibility of the disuse of the block heater 19 under the state where the cooling water is not circulated. The estimation of the possibility of the usage or the disuse of the block heater 19 is executed on the basis of circumstances such as an environmental condition of the internal combustion engine not requiring the circulation of the cooling water. In other words, in the case where the control unit 5 determines that the internal combustion engine is apparently not in the circumstance where the block heater 19 needs to be used, the block heater disuse estimating portion 61 estimates that the block heater 19 is not used. In this case, the control unit 5 proceeds to the following control processes such as the warm-up drive, a failure detection process for the fluid temperature detecting device (53, 84, 85) and the like. Furthermore, in the case where the block heater disuse estimating portion 61 does not estimate the disuse of the block heater 19, the block heater usage determining portion 62 determines the usage or the disuse of the block heater 19 on the basis of the changes in the fluid temperature while the cooling water is circulated. The determination algorithm may be configured so as to, for example, determine whether or not the temperature difference between the current cooling water temperature and the maximum cooling water temperature, in other words, the decrease of the cooling water temperature from when the engine is started to the present time, is greater than the threshold value, so as to determine that the block heater 19 is used in the case where the temperature difference is greater than the threshold value, and so as to determine that the block heater 19 is not used in the case where the temperature difference is equal to or lower than the threshold value.

More specifically, in the case where the soak time is not long enough for attaching the block heater 19 to the internal combustion engine and heating the cooling water, the block heater 19 is determined not to be used. The block heater 19 is generally used for warming the internal combustion engine in cold climates. Therefore, in the case where the environmental temperature indicates the temperature that does not require the warming up of the internal combustion engine by means of the block heater 19, the block heater 19 is estimated not to be used. Furthermore, in the case where the soak time is long enough, the cooling water temperature is considered to correspond to substantially the same temperature as the environmental temperature (i.e. the cooling water temperature is considered to be substantially the same as the ambient temperature, i.e. the intake air temperature). Therefore, in a case where the cooling water temperature is higher than the environmental temperature although the soak time is long, the block heater 19 may be considered to be in use. In other words, in a case where the soak time is long enough and the difference between the cooling water temperature and the environmental temperature is small, the block heater 19 may be estimated not to be used.

According to the embodiment, in the case where the block heater disuse estimating portion 61 estimates that the block heater 19 is not in use, the temperature control system for the internal combustion engine warms up the internal combustion engine without executing the determination at the block heater usage determining portion 62 and without circulating the coolant.

In the case where the block heater disuse estimating portion 61 estimates that the block heater 19 is not in use, the internal combustion engine may be warmed up without circulating the cooling water. Accordingly, the internal combustion engine may be promptly warmed up, which may further result in reducing the fuel consumption of the internal combustion engine.

According to the embodiment, the block heater disuse estimating portion 61 estimates the disuse of the block heater 19 on the basis of the down time of the internal combustion engine from when the internal combustion engine is stopped to when the internal combustion engine is re-started.

According to the embodiment, the block heater disuse estimating portion 61 estimates the disuse of the block heater 19 on the basis of the environmental temperature of the internal combustion engine.

According to the embodiment, the block heater disuse estimating portion 61 estimates the disuse of the block heater 19 on the basis of the fluid temperature distribution at the coolant passage 31 of the coolant.

According to the embodiment, the flow of the coolant circulated by the coolant circulating apparatus 100 while the determination of whether or not the block heater 19 is in use is being executed by the block heater usage determining portion 62 is set to be lower than the flow of the coolant circulated by the coolant circulating apparatus 100 while the internal combustion engine is cooled down.

The circulation flow of the cooling water while the determination is executed by the block heater usage determining portion 62 is set to be smaller than the circulation flow of the cooling water while the internal combustion engine is cooled down. Accordingly, an interference to the warming up of the internal combustion engine while the determination is executed by the block heater usage determining portion 62 may be controlled to be a minimum, so that the internal combustion engine is promptly warmed up.

According to the embodiment, the temperature control system for the internal combustion engine further includes the fluid temperature detection failure determining portion 56 determining the failure of the fluid temperature detecting device (53, 84, 85) on the basis of the changes in the fluid temperature of the coolant while being circulated.

The fluid temperature serves as an important control parameter for the control of the internal combustion engine. Therefore, the failure determination of the fluid temperature detecting device (53, 84, 85) is essential. According to this embodiment, because the coolant circulating apparatus 100 is configured so as to control the circulation of the cooling water (i.e. the execution and stoppage of the circulation of the cooling water), the circulation of the cooling water may be executed only when the failure determination of the fluid temperature detecting device (53, 84, 85) needs to be executed. As a result, a fuel consumption of the vehicle may be reduced.

According to the embodiment, the temperature control system for the internal combustion engine further includes the warm-up drive controlling portion 57 driving the internal combustion engine under the condition that the circulation of the coolant is stopped.

Accordingly, the warm-up drive without the circulation of the cooling water, which contributes to the reduction of the fuel consumption, may be achieved.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A temperature control system for an internal combustion engine, to which a block heater for warming a coolant and keeping the coolant warm is attachable, the temperature control system comprising:

a coolant circulating apparatus configured so as to circulate the coolant;

a fluid temperature detecting device configured so as to detect a fluid temperature of the coolant;

a block heater disuse estimating portion implemented by a control unit and configured so as to estimate a possibility of disuse of the block heater, wherein the estimating takes place when a circulation of the coolant is stopped by the coolant circulating apparatus; and a block heater usage determining portion implemented by the control unit and configured so as to determine whether or not the block heater is used on the basis of changes in the fluid temperature detected by the fluid temperature detecting device under a condition that the coolant is circulated by the coolant circulating apparatus in a case where the block heater disuse estimating portion does not estimate the disuse of the block heater.

2. A temperature control system for an internal combustion engine, to which a block heater for warming a coolant and keeping the coolant warm is attachable, the temperature control system comprising:

a coolant circulating apparatus configured so as to circulate the coolant;

a fluid temperature detecting device configured so as to detect a fluid temperature of the coolant;

a block heater disuse estimating portion implemented by a control unit and configured so as to estimate whether or not the block heater is used, wherein the estimating takes place when a circulation of the coolant is stopped by the coolant circulating apparatus; and a block heater usage determining portion implemented by the control unit and configured so as to determine whether or not the block heater is used under a condition that the coolant is circulated by the coolant circulating apparatus.

3. The temperature control system for the internal combustion engine according to claim 2, wherein, in a case where the block heater disuse estimating portion estimates that the block heater is not in use, the temperature control system for the internal combustion engine warms up the internal combustion engine without executing a determination at the block heater usage determining portion and without circulating the coolant.

4. The temperature control system for the internal combustion engine according to claim 1, wherein the block heater disuse estimating portion estimates the disuse of the block heater on the basis of a down time of the internal combustion engine from when the internal combustion engine is stopped to when the internal combustion engine is re-started.

5. The temperature control system for the internal combustion engine according to claim 2, wherein the block heater disuse estimating portion estimates disuse of the block heater on the basis of a down time of the internal combustion engine from when the internal combustion engine is stopped to when the internal combustion engine is re-started.

6. The temperature control system for the internal combustion engine according to claim 1, wherein the block heater disuse estimating portion estimates the disuse of the block heater on the basis of an environmental temperature of the internal combustion engine.

7. The temperature control system for the internal combustion engine according to claim 2, wherein the block heater disuse estimating portion estimates disuse of the block heater on the basis of an environmental temperature of the internal combustion engine.

8. The temperature control system for the internal combustion engine according to claim 1, wherein the block heater disuse estimating portion estimates the disuse of the block heater on the basis of a fluid temperature distribution at a circulation passage of the coolant.

9. The temperature control system for the internal combustion engine according to claim 2, wherein the block heater disuse estimating portion estimates disuse of the block heater on the basis of a fluid temperature distribution at a circulation passage of the coolant.

10. The temperature control system for the internal combustion engine according to claim 1, wherein a flow of the coolant circulated by the coolant circulating apparatus when the block heater usage determining portion executes a determination is set to be lower than a flow of the coolant circulated when the internal combustion engine is cooled down.

11. The temperature control system for the internal combustion engine according to claim 2, wherein a flow of the coolant circulated by the coolant circulating apparatus when the block heater usage determining portion executes a determination is set to be lower than a flow of the coolant circulated when the internal combustion engine is cooled down.

12. The temperature control system for the internal combustion engine according to claim 1 further comprising a failure determining portion determining a failure of the fluid temperature detecting device on the basis of the changes in the fluid temperature of the coolant while being circulated.

13. The temperature control system for the internal combustion engine according to claim 2 further comprising a failure determining portion determining a failure of the fluid temperature detecting device on the basis of changes in the fluid temperature of the coolant while being circulated.

14. The temperature control system for the internal combustion engine according to claim 1 further comprising a warm-up drive controlling portion driving the internal combustion engine under the condition that the circulation of the coolant is stopped.

15. The temperature control system for the internal combustion engine according to claim 2 further comprising a warm-up drive controlling portion driving the internal combustion engine under the condition that the circulation of the coolant is stopped.

16. The temperature control system for the internal combustion engine according to claim 1, wherein the block heater usage determining portion is not executed in a case where the block heater disuse estimating portion estimates that the block heater is not used.

17. The temperature control system for the internal combustion engine according to claim 2, wherein the block heater usage determining portion is not executed in a case where the block heater disuse estimating portion estimates that the block heater is not used.

* * * * *